United States Patent [19]

Wysocki

[11] 3,980,476

[45] Sept. 14, 1976

[54] IMAGING SYSTEM

[75] Inventor: Joseph J. Wysocki, Webster, N.Y.

[73] Assignee: Xerox Corporation, Stamford, Conn.

[22] Filed: Jan. 27, 1975

[21] Appl. No.: 544,089

[52] U.S. Cl. ..... 96/1.1; 96/1.5; 340/173 TP; 346/74 TP; 178/6.6 TP; 346/77 E

[51] Int. Cl.[2] ..... G03G 16/00

[58] Field of Search ..... 96/1.1, 1.5; 340/173 TP; 346/74 TP, 77 E; 178/6.6 TP

[56] References Cited

UNITED STATES PATENTS 3,716,359 2/1973 Sheridon ..... 96/1.1

*Primary Examiner*—John D. Welsh

*Attorney, Agent, or Firm*—James J. Ralabate; Michael H. Shanahan; John B. Mitchell

[57] ABSTRACT

There is disclosed an imaging system for forming a plurality of images on the same surface, at least one of which is permanent and one of which is erasable. The imaging system includes an electro-optic imaging member which has a "built-in" master image.

7 Claims, 4 Drawing Figures

IMAGING SYSTEM

BACKGROUND OF THE INVENTION

This invention relates generally to an imaging system for forming a plurality of images and, more specifically to such a system which includes an electro-optic imaging member.

There is known in the imaging art a broad class of imaging devices which record optical images by an imagewise distribution of photogenerated voltages or currents acting upon a voltage or current-alterable recording medium. Examples of imaging devices which belong to this class are the Ruticon devices, FERPIC devices, Phototitus devices and liquid crystal devices. Typically, in these devices, imagewise activating radiation incident on a photoconductor allows charge carriers to move in an external electric field. These charge carriers interact with a voltage or current-sensitive member which, in turn, modulates light.

In the Ruticon (derived from the Greek words "rutis" for wrinkle and "icon" for image) family of devices described by Sheridon in *IEEE Transactions on Electron Devices*, September, 1972 and U.S. Pat. No. 3,716,359, the voltage-sensitive, light modulating recording medium comprises a deformable elastomer layer and the photoconductive material may be provided as a separate layer or incorporated in the elastomer layer. Various embodiments for establishing an electric field across the elastomer layer are possible including depositing a thin metallic conductive layer which serves as an electrode over the elastomer layer in the embodiment referred to as the Gamma-Ruticon.

The Phototitus devices, described by Grenat, Pergrale, Donjon and Marie, *Applied Physics Letters*, Vol. 21, No. 3, Aug. 1, 1972, have sandwich structures comprising a $KD_2PO_4$ crystal as the voltage-sensitive, light modulating layer arranged adjacent to a photoconductive layer. The $KD_2PO_4$ crystal reacts to the light-induced voltage distribution produced by the photoconductive layer by changing the polarization of transmitted light, a phenomenon called the electrooptic effect, or the Pockels effect.

The FERPIC devices, which are described for example, by Meitzler and Maldonado in *Electronics*, Feb. 1, 1971 and by Smith and Land in *Applied Physics Letters*, Vol. 24, No. 4, Feb. 15, 1972, include a PLZT (lead-zirconate titanate doped with Lanthanum) ceramic material as the voltage-sensitive, light-modulating element. Like the $KD_2PO_4$ crystal in the Phototitus devices, the PLZT ceramic material responds to the altered electric field produced by the photoconductive layer by changing the polarization of transmitted light. In some PLZT devices, the effect used is an electric field-induced change in the degree to which transmitted light is scattered. Unlike the $KD_2PO_4$ crystals, the effects produced in the PLZT ceramics do not disappear when the electric field is removed. Because of their similarities, the materials used in the Phototitus and FERPIC devices will be referred to herein as "electro-optic effect materials".

Many imaging devices in which liquid crystalline materials are used as the recording medium are known such as, for example, those described by Margerum et al, *Applied Physics Letters*, Vol. 19, No. 7, Oct. 1, 1971. In these devices, the light modulating liquid crystal layer may be either voltage or current alterable. For example, devices which include nematic liquid crystalline materials as the recording medium display voltage-sensitive light modulating properties when operated above a certain threshold voltage. Various nematogenic materials will also exhibit dynamic scattering when acted upon by an electric current.

Electro-optic imaging devices of this general type have been the subject of increasing attention recently because of the many applications in which they may be utilized and the excellent performance which they are capable of providing. Two important areas where devices of this type may be effectively utilized are image intensification and image storage. In relatively new and growing areas of technology such as electro-optic imaging systems, new imaging members, materials for use in the imaging members and the use of the imaging members in new modes continue to be discovered. The present application relates to a novel and advantageous imaging system for forming a plurality of images on the same surface.

SUMMARY OF THE INVENTION

It is therefore an object of this invention to provide a novel electro-optic imaging system.

It is another object of this invention to provide a method for forming a plurality of images on a recording medium.

It is another object of this invention to provide an imaging method in which a plurality of images is formed in an electro-optic imaging member.

A further object of this invention is to provide an imaging method which is capable of operating in a recyclable mode and wherein one image comprises permanent information and at least one image comprises variable information.

A still further object of this invention is to provide such an imaging method wherein the variable image information is supplied in a real-time mode.

Yet another object of this invention is to provide such an imaging method, wherein the permanent image information is the result of a modification of at least one of the structural elements of an electro-optic imaging member.

Another object of this invention is to provide such an imaging method wherein the permanent image information is the result of an imagewise modification of an interface and/or the bulk of the photoconductive or elastomer layers of the imaging member.

Another object of this invention is to provide such an imaging method wherein the permanent image information is the result of an imagewise modification of the surface electrode.

Another object of this invention is to provide such an imaging method wherein the permanent image information is the result of an imagewise modification of the NESA electrode.

Still another object of this invention is to provide such as imaging method wherein the permanent image information is the result of an imagewise cold-working of the surface electrode and/or the elastomer layers of the imaging member.

Another object of this invention is to provide such an imaging method wherein the permanent image information is a periodic or aperiodic screen pattern.

These and other objects are accomplished by providing an imaging system for forming a plurality of images on the same surface at least one of which is permanent and one of which is erasable. The imaging system includes an electrooptic imaging member which has a "built-in" master image.

BRIEF DESCRIPTION OF THE DRAWINGS

For a better understanding of the invention as well as other objects and further features thereof, reference is made to the following detailed disclosure of various preferred embodiments of the invention taken in conjunction with the accompanying drawings thereof wherein.

DESCRIPTION OF THE PREFERRED EMBODIMENTS

Figure 1:
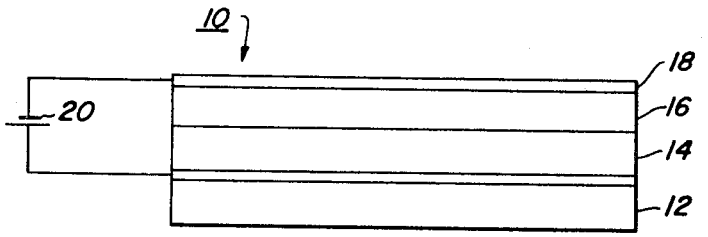
FIG. 1 is a partially schematic, cross-sectional view of an electro-optic imaging member of the type suitable for use with the instant invention.

FIG. 1 illustrates a generalized imaging member utilized in the imaging system of the invention. Referring now to that figure, there is seen the imaging member, generally designated 10, which comprises optional substrate 12, photoconductive layer 14, voltage or current-sensitive, light modulating layer 16 and surface charging means, shown hereas a conductive layer 18 connected to one side of here as source of electrical potential 20 which may be A.C., D.C. or a combination thereof. The external circuit may also include suitable switching means (not shown). Of course, it will be appreciated that conductive layer 18 may be eliminated when the electric field is established by means of corona charging such as where corona charging means, for example, those disclosed in U.S. Pat. Nos. 2,777,957 and 2,836,725 are used to deposit charge on the surface layer 16 while the other side of the imaging member is grounded. Alternatively, the field across the imaging member may be established by the double sided corona charging technique wherein one corona charging device is arranged on each side of the imaging member. Typically, the corona charging devices are oppositely charged in this embodiment and are traversed more or less in register. It should be noted that it is possible to have a substrate in the imaging member when the field is established in this manner, in which case it need not be laterally conductive.

Optional substrate 12 may comprise any suitable material possessing the requisite mechanical properties and may be transparent or opaque depending upon what materials are used in the imaging member and how the imaging member is used. In embodiments where an electrically conductive substrate is used, the substrate may be a single layer of conductive material where it may comprise a transparent conductive layer arranged on a suitable substrate such as, for example, glass or plastic materials. Typical suitable transparent conductive layers include continuously conductive coatings of conductors such as indium oxide, tin oxide, thin layers of tin, aluminum, chromium or any other suitable conductors. These substantially transparent conductive coatings are typically evaporated or sputtered onto the more insulating transparent substrate. NESA glass, a tin oxide coated glass manufactured by the Pittsburgh Plate Glass Company, is a commercially available example of a typical transparent conductive layer coated over a transparent substrate. It should be noted here that the conductive layer 18 may comprise any of the above described materials. It is preferred to have a substrate in the imaging member because it provides mechanical support for the other layers in the member.

Photoconductive layer 14 may comprise any photoconductive insulating material which is capable of cyclically withstanding small imagewise deformations (small in comparison to those of the elastomer) without fracturing or otherwise losing its ability to function within the system. Typical suitable photoconductive layers include poly-n-vinyl carbazole or aromatic phenolic resins as described in U.S. Pat. Nos. 3,408,183; 3,408,186; 3,408,188 and 3,408,190 sensitized for red light by the Brilliant Green Dye produced by the General Dye Stuff Co., a Division of General Aniline and Film Corp., or the same material sensitized by Lewis Acids or other dyes such as trinitro-9-fluorene for blue sensitivity, and photoconductive elastomers as described in U.S. Pat. No. 3,716,359. Any suitable photoconductive layer may be used; however, it has been found more advantageous to use organic photoconductors or inorganic photoconductors in an organic matrix. Inorganic photoconductors may be used if the layers thereof are relatively thin.

Voltage or current-sensitive, light modulating layer 16 may comprise any suitable material which is capable of recording optical images by an imagewise distribution of photogenerated voltages or currents. Typical suitable materials include, for example, elastomers, liquid crystalline materials, electro-optic effect materials (such as Pockels effect crystals and PLZT ceramics), electrophoretic materials (charted particles in dielectric liquids), thermoplastics and movable segmented films such as are disclosed by J. A. VanRaalte in *J. Opt. Soc. Am.*, Vol. 9, No. 10, pp. 22–25, 1970 and K. Preston in *Opt. Acta.*, Vol. 16, page 579, 1970.

The imaging members and the methods thus far described are known in the art, as exemplified by the above-described Sheridon patent, and readily function in both real-time and storage modes. However, in some applications using such imaging members it may be advantageous to combine an unvarying image with one which is updated in a real-time fashion. For example, computer output may be furnished in a tabular form in which column and row headings are invariant, whereas the data are changed in a continuous manner. The instant invention supples a novel way of combining the stored and real-time features of such applications in a manner in which a single imaging member with conventional phase, or Schlieren, optics may be used. This advantageous feature is achieved by providing a built-in pattern or deformation or electrical screen within the imaging member structure, the action of any of which is to provide a steady deformation on the readout coating which can be phase-reconstructed to yield the storage image. The real-time input is introduced in standard fashion; i.e., photo-excitation of the photoconductor resulting in elastomer deformation, and both images are reconstructed simultaneously by the Schlieren system. Updating of the combined image is achieved by updating the real-time deformation. Because of the small deformations used in practice, it is assumed that the addition of deformations is linear, and that the presence of one does not modify the other.

The specific imaging members to be described in detail below can be modified in several ways to implement the instant invention. One way is to modify the reflective readout electrode 18 of the imaging member by changing its reflective properties or by varying its thickness in an imagewise fashion. A variable thickness coating may be achieved easily by employing suitable masks during the metallization procedure. Specifically, a uniform metal layer may be deposited and then the mask applied and an additional imagewise layer deposited. Alternatively, the mask may be applied and the entire metal layer deposited in imagewise fashion. In this latter mode, the electric field will have to be created by corona charging, or some means of providing electrical continuity in the layer must be employed. In another embodiment, a uniform electrode layer may be imagewise modified by the selective removal of the metal, as, for example, by acid etching, grinding, etc.

Another way of adding a stored image is by modifying the elastic properties of the elastomer 16 in an imagewise fashion, e.g., by providing regions of higher and lower compliance. This modification can be achieved by the selective application of UV irradiation or a chemical reactant such as acid. Even though these applications may be accomplished by hand or other methods, it is preferred that known masking techniques be employed. The UV irradiation embodiments require a certain amount of control and the means or methods by which this is done will be explained below with regard to modification of the photoconductor.

Another part of the imaging member in which the image may be stored with comparable convenience in fabrication is the backside of the NESA-photoconductor boundary. An image can be stored there through modification of the screen and/or conducting NESA coating. For example, by removing regions of NESA and screen in an imagewise fashion, no deformation occurs in the read-out coating in this area when voltage is applied to the unit, resulting in dark lines in the image if positive imaging is used. Alternatively, one may remove the NESA only and leave the screen, providing thereby an electrical screen. In this instance, a voltage may be applied between alternate screen lines to enhance the stored deformation.

UV-irradiation can also be advantageously applied in an imagewise fashion to the photoconductor surface to modify the ability of that layer to hold charges at the interface thereof with the elastomer. In each instance herein where the application of UV is described, there is a wide range of wavelengths which are acceptable to perform the desired result. One of skill in the art will realize that the total dosage necessary for a specific desired result is a function of time and intensity. These parameters depend upon layer absorption characteristics, thickness, etc.

It has also been found that a permanent image deformation can be cold-worked into the imaging member by repeated cycling of one input image. Any of the elements making up the imaging member may be cold-worked; however, it is usually the surface electrode which first exhibits this characteristic. The extent to which this phenomenon becomes evident depends upon the number of cycles used, the material of which the electrode is made and the thickness of the material.

Under certain circumstances, it is possible to permanently deform the elastomer by the application of voltage, and thereby create a stored image. The voltage levels typically required to form and "lock" the deformation images would be in the range of from about 1 to about 25,000 volts or higher depending, inter alia, on the thickness and other characteristics of the elastomer layer 30. See, for example, Col. 13 of the Sheridon patent mentioned above.

It should be further understood that since interfacial conditions play a role in image quality and maintenance via the connection between charge and deformation they also can be modified to form the stored pattern. These conditions affect (1) charge storage and/or trapping; (2) lateral charge migration; and (3) charge injection. Charge storage and/or trapping provides for the maintenance of a charge distribution without loss due to recombination. Lateral charge migration permits change in charge distribution by sidewise flow; thereby distorting the original distribution. Charge injection causes a traverse charge flow through the interface, reducing the amount of charge which remains. In stored-image areas, the charge storage and/or trapping should be long, i.e., there should be little charge migration or injection. In up-datable areas, charge storage and/or trapping should be short and/or lateral migration should be high and/or charge injection should be high. The instant invention, in part, may result in interfacial modifications, as described above. The various process steps or treatments described herein, such as, for example, irradiation, vapor, chemical and mechanical treatments are each capable of achieving the desired results.

In a preferred embodiment, it has been found that a highly acceptable line screen pattern, as opposed to line copy information, may be permanently impressed onto the imaging member, thus eliminating the cost and difficulty of fabricating such in the member.

In operation, an electric field is applied across imaging member 10 which contains the permanent information and the member is uniformly exposed to activating electromagnetic radiation to which the photoconductive material comprising layer 14 is sensitive, thereby rendering conductive those areas of layer 14 which receive radiation and establishing an imagewise pattern in or on voltage or current-sensitive light-modulating layer 16. The voltage drop across the photoconductive layer-light modulating layer sandwich is typically in the range of from about 0.1 volt to about 25,000 volts depending upon the material which comprises light-modulating layer 16, the thickness of layers and certain properties of the photoconductive material, the dielectric constant in particular.

The updating, or non-permanent, information may be directed upon the imaging member through the upper surface thereof or through the substrate depending, inter alia, upon the properties of the various layers of the imaging member, the particular voltage or current-sensitive, light-modulating material employed and the nature of the activating radiation comprising the image information. Of course, it will be recognized that the present method is intended to be practiced preferably in a manner such that registration of the respective imagewise patterns on the imaging member will preclude any overlap in the image patterns formed in or on layer 18, and, consequently, on any hard copy reproductions or visual displays formed therefrom. However, it should be noted that some overlap may occur without substantially affecting the results obtained. With respect to the reproduction of line copy which typically comprises the bulk of the copy reproduced, substantial areas of the original material are comprised of background. For example, a U.S. Patent on pages completely filled with single-space information has a background area of about 90 percent with about 10 percent of the total imaging area of the page taken up by character information. Thus, it will be clearly evident that any overlap between, for example, character information on a standard form could be tolerated and would not present any significant problems in the practice of the invention. It should also be noted that the respective images formed in the imaging member according to the invention may be in side-by-side relationship. Thus, it would be understood that the method of the invention broadly contemplates forming a plurality of images on an imaging member and the plurality of images may have any relative position to each other within the imaging area of the member.

The imagewise patterns formed in or on the voltage or current-sensitive, light-modulating layer 16 may be read out by various techniques depending upon, inter alia, the particular type of voltage or current-sensitive, light-modulating layer present in the imaging member. Generally, the imagewise patterns may be read out in reflection or in transmission. Image enhancement means such as polarizers may also be utilized in reading out the images. Such image enhancement means are preferred when birefringence effects in the light modulating layer 16 are exploited to form the images therein. In the embodiments where light modulating layer 16 comprises a deformable material such as an elastomer and deformation images are formed, it is preferred to employ a phase sensitive image reconstruction system such as a Schlieren optical system.

The real-time images are typically held by the imaging member for a time period sufficient for viewing or producing the desired number of copies. This time period is generally in the range of from about 1 second to about $10^4$ seconds or more. These images may be erased by any of the well-known techniques including flooding with light, reversing the field, allowing it to decay, heating or a combination thereof.

As noted above, potential source 20 may be A.C., D.C. or combinations thereof. The potential source 20 should be capable of being turned off to more rapidly erase the images formed or undergo a shift in polarity to accomplish the same.

The invention has been described with respect to a general imaging member. Various preferred embodiments of imaging members suitable for modifications according to the instant invention will now be described, and it should be understood that various specific elements in addition to those illustrated in FIG. 1 may be required in these various embodiments.

Figure 2:
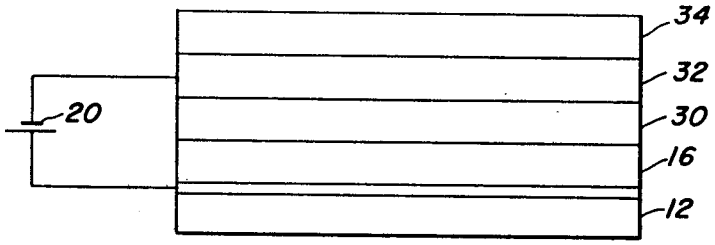
FIGS. 2, 3 and 4 are partially schematic, cross-sectional views of other embodiments of electro-optic imaging members suitable for use with the instant invention.
Figure 3:
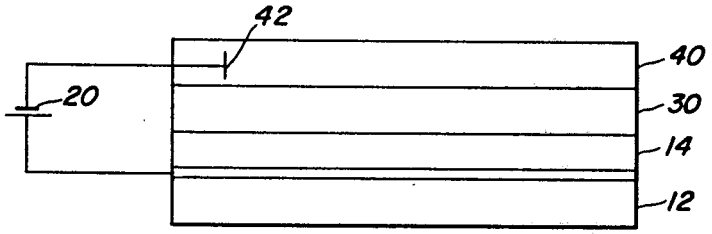
Figure 4:
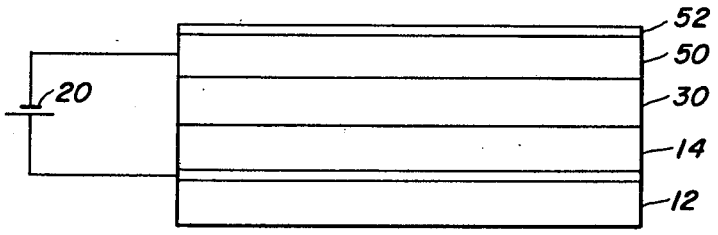

Particularly preferred imaging members according to the present invention are those wherein the voltage or current-sensitive light-modulating layer comprises a deformable elastomer material. It should be understood that the term "elastomer" is meant to include a usually amorphous material which exhibits a restoring force in response to a deformation; that is, an amorphous material which deforms under a force and, because of volume and surface forces, tends to return to the form it had before the force was applied. A detailed description of members including a deformable elastomer layer is found in U.S. Pat. No. 3,716,359. FIGS. 2, 3 and 4 illustrate embodiments of imaging members including a deformable elastomer layer. These imaging members are similar to the member illustrated in FIG. 1 and like elements are identified by the same numerals.

FIG. 2 illustrates an imaging member wherein a layer of a conductive liquid serves as one of the electrodes. In this embodiment, voltage sensitive light-modulating layer 30 comprises a deformable elastomer material. Any suitable elastomer material may be used to form layer 30. Typical suitable elastomeric materials for use in the imaging devices of the invention include both natural (such as natural rubber) and synthetic polymers which have rubber-like characteristics; i.e., are elastic, and include materials such as styrene-butadiene, polybutadiene, neoprene, butyl, polysoprene, nitrile, urethane and ethylene rubbers. A preferred class of elastomer materials includes water based gelatin gels and dimethylpolysiloxane gels. The elastomers generally should be reasonably good insulators and typically have volume resistivities above about $10^4$ ohm-cm and shear moduli of from about 10 to about $10^8$ dynes/cm$^2$ and dielectric strengths above about 10 volts/mil. Preferably, the elastomers will have volume resistivities above about $10^{13}$ ohm-cm, shear moduli of from about $10^2$ to about $10^5$ dynes/cm$^2$ and dielectric strengths greater than about 500 volts/mil. Commercially available elastomers which have been found to be suitable for use include Sylgard 182, Sylgard 184, Sylgard 188 (available from Dow Corning Company), RTV 602 and RTV 605 (available from General Electric Company). The higher volume resistivity elastomers are preferred since they typically provide extended storage capability. Elastomers having relatively high dielectric strength are preferred because they typically allow the imaging members to be operated at relatively high voltage levels which is desirable.

A particularly preferred elastomer is a transparent, very compliant composition which comprises an elastomeric dimethylpolysiloxane gel made by steps including combining one part by weight of Dow Corning No. 182 silicone resin potting compound, about 0.1 part by weight of curing agent and anywhere from about zero to about 30 parts by weight of Dow Corning No. 200 dimethylpolysiloxane silicone oil. Other suitable resins include transparent flexible organosiloxane resins of the type described in U.S. Pat. No. 3,284,406 in which a major portion of the organic groups attached to silicone are methyl radicals.

The thickness of elastomer layer 30 is typically in the range of from about 0.1 micron to about 200 microns depending, inter alia, upon the spatial frequency of the information to be recorded. It is preferred that elastomer layer 30 be from about 1 to about 10 microns thick. Various optical properties of the imaging device may be enhanced by a suitable selection of the elastic modulus of the particular elastomer materials used. For example, a relatively more stiff elastomer would typically recover more rapidly from an image when the electric field is removed and thus may be erased more quickly. On the other hand, an elastomer having a relatively low elastic modulus will exhibit less resistance to large deformations and hence greater optical modulation for a given value of electric field.

The conductive liquid layer 32 may or may not be transparent. Non-transparent conductive fluids include mercury, room temperature molten gallium-indium alloys, etc. Transparent conductive fluids include water to which conductive impurities have been added. When transparent, fluid 32 should typically have a substantially different refractive index than elastomer 30 in order that deformations of the elastomer surface will phase modulate the illuminating light. A transparent fluid may also be used for read out in the reflection mode which may be enhanced by arranging a thin, flexible, transparent layer on elastomer layer 30. Such a flexible, transparent layer should typically have a substantially different refractive index than either the elastomer layer 30 or the transparent conductive fluid.

Window layer 34 may be any suitable material such as, for example, normal optical property glass, which is capable of maintaining conductive fluid 32 in contact with elastomer layer 30. It should be noted that many conducting transparent fluids typically undergo electrolysis in a D.C. electric field. This is undesirable because it leads to a deterioration of the elements of the imaging device as well as evolution of gas. Thus, in operation of imaging devices including conductive transparent fluids, it is typically preferred to use an A.C. electric field. Of course, it will be recognized that the image information may be projected upon the imaging member, and the image patterns may be read out, by any of the techniques described above herein.

In operation, a field created by voltage from potential source 20 is applied across the imaging member and exposure to the imagewise pattern of radiation is effected. The electric field across the elastomer layer 30 is varied in a manner corresponding to the image radiation pattern. The electrical force of the electric field across the elastomer layer causes it to deform and this deformation will proceed until the forces of the electric field are balanced by the surface tension and elastic forces of the elastomer. At this point, the deformation stops and typically becomes stable as long as the electric field across the elastomer is maintained. To erase the images, the field across the elastomer is removed. In a preferred embodiment, erasure is effected by reversing momentarily the polarity across the elastomer layer, this technique typically providing more rapid erasure. With some photoconductors, rapid erasure requires an additional step of flooding the photoconductor with uniform activating radiation.

It should be noted that the deformations in elastomeric materials are different from those occurring in thermoplastic materials in that elastomer deformations are independent of any developing step such as heat and/or solvent softening steps typically necessary with thermoplastic deformation imaging materials. Another difference between elastomers and thermoplastics is that deformations in the former generally assume a definite limit for a given electric field because elastic and surface tension forces oppose the deformation. Of course, instabilities can occur at high fields at which mechanical forces do not exactly counter balance electrical forces. The thermoplastic deformations do not encounter such a definite limit for a given field as long as the thermoplastic is maintained in a softened condition.

Although not illustrated, it should be recognized that according to a preferred embodiment of the invention, an absorption type line grating is arranged between the projected imagewise radiation and the photoconductor of the imaging member. That is, such a line grating is used in those embodiments wherein the grating itself is not the permanent image information imposed according to this invention. The line grating allows the elastomer layer to record images having spatial frequencies substantially lower than the resonate deformation frequency of the elastomer. The elastomer will deform along the pattern of the high spatial frequency screen in those areas where it is illuminated. The screened surface relief image formed on the elastomer will be made up of segments of the shadow of the screen. The image obtained when a deformed elastomer is illuminated will therefore have a fine structure of lines superimposed upon the original image that was recorded. If the line structure is objectional, it may be removed by suitable optical filtering techniques which are well-known in the art.

It is preferred to place the screen (for example, a line grating) immediately adjacent to the photoconductive layer in the imaging device. Other types of screen that may be used and, if desired, similarily located are described in U.S. Pat. Nos. 3,698,893 and 3,719,483. It should be noted here that screens may be incorporated in any of the devices constructed according to the present invention, where appropriate.

In certain preferred embodiments it is possible to create a screen pattern in the photoconductor or elastomer by optical techniques. For example, the photoconductive layer can be exposed to uniform illumination to which it is sensitive through a line grating hence a persistent conductivity pattern corresponding to the screen will be formed in the layer. Also, for example, the elastomer layer can be exposed to uniform UV-irradiation through a line grating thereby forming a permanent pattern of lower deformability corresponding to the screen. It should also be noted that the imaging member could include two or more different color gratings in which case the member could be used in a multicolor image reproduction system.

FIG. 3 illustrates an imaging member according to the invention wherein a layer of conductive gas serves as one of the electrodes. The embodiment is essentially identical with that illustrated in FIG. 2 with the exception that the thick conductive liquid layer 32 in FIG. 2 is replaced by a conductive gas 40 and requires means for ionizing the gas 42 which may include a transparent conducting window. The conductive gas 40 may be obtained by means of glow discharge through a low pressure gas of a few millimeters of mercury pressure, or by low pressure arc discharge which commonly takes place at a few microns of mercury pressure. The gas may also be ionized by means of intense radioactivity in or near a low pressure gas 40, or a radio frequency excitation of the gas in the cavity or other techniques for producing a conductive gaseous plasma which are well-known in the art. Charging of the elastomer surface may also take place if gas 40 is at a sufficiently high vacuum and contains a source of thermally excited electrons, such as a heated tungsten filament which is directed against the elastomer surface. This may be a scanned beam as from an electron gun, or an unscanned beam, or from a multiplicity of electron emitting sources. A reflective layer may also be placed over layer 30 on the surface interface between layers 30 and 40. The conductive gas layer 40 may be between 0.1 microns thick to an indefinite thickness. As set forth above, gas ionizing means 42 may be a separate electrode or may be coupled to the transparent conducting window to contain the conductive gas against elastomer layer 30. The container for preventing the conductive gas 40 from escaping would, of course, have to be airtight to contain the gas at the necessary level of vacuum.

FIG. 4 illustrates a particularly preferred embodiment of a Ruticon imaging device wherein the electric field is created across the elastomer layer 30 by means of a thin continuous conductive layer 50 on the surface of the elastomer, which layer is sufficiently flexible to follow the deformation of the elastomer. In the case where this layer 50 is highly reflective, this apparatus will utilize the readout light with great efficiency. If the layer is opaque, light propagating through the substrate may be used to form the surface deformation images while simultaneously light propagating from above may be used to reconstruct the image. The light sources used may be of different wavelengths and/or intensities and/or one light source may be coherent and the other non-coherent. Hence, this device may be used to convert images formed in particular wavelengths into equivalent images formed in different wavelengths. Also, if the readout light incident from the top is very much more intense than the imaging light incident from the bottom, apparatus shown in FIG. 4 will provide great amplification of input images, the amplified light being used, for example, for large panel displays. Furthermore, the reconstruction light may be coherent, e.g., that produced by a laser, so that an image processing step may be performed on the surface deformation images which are formed with non-coherent light propagating from the bottom. On the other hand the light giving rise to the surface deformation images may be coherent light while the reconstruction light may be non-coherent. This latter case is desirable because non-coherent light is more pleasing to the human eye and current coherent light generators are typically limited to production of light within narrow wavelength bands, i.e., one color such as red. A reason for having coherent light for forming the surface deformation images arises when it is reconstruction light for forming input images from holograms. Therefore, the present device may have a holographically reconstructed image projected onto it forming a surface deformation image that is viewed with non-coherent light of substantially greater intensity as suited for large panel displays.

It is again noted that substrate 12 may be opaque or transparent. The thin conductive layer 50 typically should be flexible enough to follow the deformations of elastomer layer 30. Where, for example, conductive layer 50 is opaque, such as a thin metal film substrate 12 must be transparent to allow the imagewise radiation pattern to reach photoconductive layer 14. In this case, image information may be readout continuously when the readout illumination is incident from above the member. Where the thin conductive layer 50 is transparent, readout light may be reflected from its surface and the member may be used in transillumination provided the other layers are transparent.

Conductive layer 50 may comprise a thin layer of suitable metal material or a combination of two or more metals. Such metallic layers would typically be between approximately 50 angstroms to several thousand angstroms thick depending, inter alia, on the desired flexibility and the requisite conductivity. Layer 50 could also be transparent such as, for example, where a film of Dow Corning resin ECR 34 is coated on the surface of elastomer layer 30. Other conductive layers such as may occur to those skilled in the art may also be used within the scope of the invention.

Thin conductive layer 50 typically has sufficient conductivity to become an equipotential surface when connected to an electrical energy source; sufficient flexibility to follow the deformations of the elastomer; sufficient fatigue resistance to withstand numerous and rapid formations and erasures of surface deformations; and, in some cases, high opacity and reflectivity as when being read out by a high intensity light source to which the photoconductive layer is sensitive.

Conductive layer 50 preferably comprises gold and indium, or chromium and silver, silver and titanium or combinations thereof. Although layer 50 may be formed on elastomer layer 30 by various methods, such as, for example, by chemical reaction, precipitation out of a solution, electrophoresis, electrolysis, etc., it is preferred to form the layer by vacuum evaporation techniques. For a detailed description of the vacuum evaporation technique for forming metal layers including gold and indium on elastomer layer surfaces, see U.S. Pat. No. 3,716,359. It should be noted that there are other materials which may be added to the metallic layer to enhance or suppress particular characteristics such as, for example, spectral reflectivity and corrosion resistance.

Optionally, the imaging device illustrated in FIG. 4 may also include a transparent layer 52 of an insulating liquid, for example, oil. There are a number of advantages provided by the use of layer 52. The insulating liquid layer serves an important function when it has an index of refraction different than that of air. The presence of layer 52 over the flexible conductive layer 50 means light propagating from above the member will be modulated more than it would if only air were present. The reason for this is that for the same magnitude of surface deformation, the optical path changes are proportional to the refraction index of the medium adjacent to the surface. As a consequence, if it were desired to maintain the same modulation as is provided by a device without layer 52, it would be possible to do so at lower voltages thereby ameliorating the possibility of voltage breakdown. The second advantage is that layer 52 serves as protection for conductive layer 50 by isolating it from contamination by dust or the like, maintaining a more constant ambient environment, etc. Additionally, layer 52 makes less stringent fabrication requirements for the imaging member. The presence of pin holes in the elastomer layer 30 may cause the imaging member to short circuit, possibly destroying its performance. The addition of layer 52 may prevent such short circuits from disrupting the performance of the member by allowing insulating liquid to flow into such pin holes.

For greater accuracy and convenience, the thickness of the metal layers will be expressed below herein in terms of frequency change. Measurements are made with a 5 MHz Sloan Thickness Monitor which relates thickness of deposite to frequency change in a resonating quartz system. In principle frequency change can be converted into thickness units by the formulas: $t_{CR} = 0.278\Delta f$ and $t_{AG} = 0.190\Delta f$. When $\Delta f$ is in Hz, $t$ is in A. These formulas assume the deposited material has a density equal to that of bulk material. This assumption is rarely correct when the substrate (in this case the elastomer) is a relatively soft material. In those cases the effective density may be 2 or 3 times smaller than bulk density so that the thickness values determined by the above formulas are too low by approximately the same factor. Thus, because of the uncertainty in the coating density, it is preferred to specity the metal layer thickness in terms of frequency change.

The advantageous imaging system of the present invention will be further described with respect to its specific preferred embodiments by way of Examples, it being understood that these are intended to be illustrative only and the invention is not limited to the materials, procedures and conditions recited therein. All parts and percentages are by weight unless otherwise specified. Also, unless otherwise specified, the application of operating voltages are with the negative potential at the bottom, or NESA, electrode.

EXAMPLE I

An image recorder is fabricated by first cutting an approximately 3½ inch × 2½ inch × ⅛ inch piece of NESA glass, available from Pittsburgh Plate Glass Co., cleaning the glass in a chromic acid bath, and dip coating the surface thereof with about 1 micron of a filtered solution of Shipley AZ-1350 photoresist, available from Shipley Co., Inc., of Newton, Mass. The photoresist is then exposed to a master screen pattern (bar pattern of 40 cycles/mm) by the light from a 500 watt Xenon arc lamp at a distance of about 3 feet for about 4 minutes. The pattern is then developed with AZ-1350 developer. The plate is next placed in a vacuum coating system and coated with a layer of chromium about 2.0 KHZ thick. The plate is then cleaned with acetone to remove the remaining photoresist and the metal coating on it.

A photoconductive solution is then prepared by dissolving 80 grams of Poly-n-vinyl Carbazole (PVK) and 0.4 grams of Brilliant Green Dye (BG) in 1000 ml of methylene chloride. Brilliant Green dye is manufactured by the General Dye Stuff, Co., a division of General Aniline and Film Corp. The mixture is stirred for a time sufficient to effect complete solution. Additional methylene chloride is then added to decrease the viscosity of the solution to about 100 cPs, as measured with a Brookfield RTV Viscometer with No. 2 spindle. The solution is then filtered and dip coated onto the plate to form an approximately 6 micron layer thereon.

An approximately 5 micron thick layer of elastomer comprising a dimethylpolysiloxane gel is applied over the photoconductive layer. The imaging member thus far described is then exposed, on the elastomer side, for about 120 minutes to UV irradiation through an opaque mask having a ½ inch diameter circle therethrough. The UV irradiation is provided by a Rayonet, type RPR-208 Photochemical Reactor which provides primary radiation at a predominant wavelength of 2537 angstroms at 45 watts of power. The reactor is manufactured by the Southern New England Ultraviolet Co. of Middletown, Conn.

Then an about 0.1 micron thick flexible conductive gold-indium layer, which serves as a second electrode, is applied to the free surface of the elastomer layer by vacuum evaporation. An electrical field of about 325 volts is established across the imaging member by applying a potential to the electrodes and the member is then uniformly exposed through the NESA glass electrode to visible light having a wavelength below 6800 angstroms. The image is read out through conventional Schlieren optics and displayed on a projection screen. It is observed that the projected image is made up of a dark circle with a light background which indicates that the desired image has been entered into the member.

EXAMPLE II

The imaged member of Example I is then subjected to a field of opposite polarity for about 1/10 second, simultaneously flooded with visible light and returned to its initial polarity, thereby erasing any temporary images.

The imaging member is then again uniformly exposed to visible light through the NESA electrode and read out with Schlieren optics. It is observed that the readout image comprises a dark circle on a light background. This indicates that the original inputted image is permanent in character.

EXAMPLE III

The imaged member of Example II is again subjected to a field of opposite polarity for about 1/10 second and simultaneously flooded with visible light and returned to its initial polarity to erase any temporary images.

The member is then exposed, with visible light, through the NESA electrode to an imagewise pattern of an opaque square on a transparent mask, out of registry with the circle.

Again the images on the member are read out and observed to comprise a dark circle and a dark square on a light background.

EXAMPLE IV

The imaged member of Example III is subjected to the described erasure procedure and then exposed through a transparent mask having an imagewise opaque pattern of a triangle thereon, out of registry with the circle and square.

Upon reading the images out it is observed that only the dark circle and triangle are visible. The square no longer exists as a viewable image and the circle is permanently impressed into the member.

EXAMPLES V – VIII

Example I is followed except that the UV exposure is for about the following time periods:

| |
|---|
| 15.5 hours |
| 8.0 hours |
| 5.0 hours |
| 2.0 hours |

In each instance the results are the same as set forth in Example I, i.e., an image is entered into the member.

EXAMPLES IX – XX

Each of the four imaged members of Examples V. - VIII are subjected to each of the steps set forth in Examples II-IV.

In each instance, it is observed that the original image is permanent and the member may be sequentially updated with erasable image information.

EXAMPLE XXI

Example I is followed up through the first sentence of paragraph 3, i.e., through the application of the elastomer layer.

One half of the member thus constructed is subjected to the fumes of aqua regia ($3HCl + HNO_3$) for about 1 hour and 17 minutes. The member is then rinsed with distilled water and dried.

Then, an about 0.1 micron thick flexible conductive gold-indium layer is applied to the free surface of the elastomer layer by vacuum evaporation.

An electrical potential of about 325 volts is applied across the member between the two conductive layers. The member is then uniformly exposed through the NESA glass electrode to visible light and the image is read out through conventional Schlieren optics and displayed on a projection screen.

It is observed that the projected image comprises a light half and a dark half, the dark half corresponding to the half subjected to the fumes.

EXAMPLE XXII

The imaged member of Example XXI is then subjected to a field of opposite polarity for about 1/10 second, simultaneously flooded with visible light and returned to its initial polarity, thereby erasing any temporary images.

The imaging member is then again uniformly exposed to visible light through the NESA electrode and read out with Schlieren optics. It is observed that the readout image comprises a light half and a dark half. This indicates that the original inputted image is permanent in character.

EXAMPLE XXIII

The imaged member of Example XXII is again subjected to a field of opposite polarity for about 1/10 second and simultaneously flooded with visible light and returned to its initial polarity to erase any temporary images.

The member is then exposed, with visible light, through the NESA electrode to an imagewise pattern of an opaque square on a transparent mask, out of registry with the half exposed to fumes.

Again the images on the member are read out and observed to comprise a dark half-plate and a dark square on a light background.

EXAMPLE XXIV

The imaged member of Example XXIII is subjected to the described erasure procedure and then exposed to an imagewise opaque pattern of a triangle on a transparent mask, out of registry with the fume exposed half-plate and square.

Upon reading the images out, it is observed that only the dark half-plate and triangle are visible. The square no longer exists as a viewable image and the dark half-plate is permanently impressed into the member.

EXAMPLES XXV – XXVII

Example XXI is followed except that the time periods of exposure to the acid fumes are about:

| |
|---|
| 1 hour |
| ½ hour |
| ¼ hour |

It is observed that in each case a permanent image is impressed into the image recorder.

EXAMPLES XXVIII – XXXVI

Each of the three imaged member of Examples XXV–XXVII are subjected to each of the steps set forth in Examples XXII– XXIV.

In each instance, it is observed that the original image is permanent and the member may be sequentially updated with erasable image information.

EXAMPLE XXXVII

Example I is followed through paragraphs 1 and 2 to produce a member comprising a NESA substrate, an optical screen and a photoconductive layer of PVK-BG.

The surface of the photoconductive layer is then contacted with a mask comprising a ½ inch diameter transparent circle on an opaque background, and irradiated with UV having a predominant wavelength of 2537 angstroms (as in previous examples) for about 14.75 hours.

The mask is then removed and the photoconductive layer coated with an about 6 microns layer of plasticized Sylgard 182 elastomer, a silicone resin potting compound available from Dow Corning. This member is then vacuum coated with an about 0.1 micron layer of gold-indium.

The member is then subjected to a potential of about 500 volts and uniformly exposed through the NESA glass electrode to visible light having a wavelength below 6800 angstroms. The image is read out through conventional Schlieren optics and displayed on a projection screen.

It is observed that the image comprises a dark circle on a light background.

EXAMPLE XXXVIII

The imaged member of Example XXXVII is then subjected to a field of opposite polarity for about 1/10 second, simultaneously flooded with visible light and returned to its initial polarity, thereby erasing any temporary images.

The imaging member is then again uniformly exposed to visible light through the NESA electrode and read out with Schlieren optics. It is observed that the read out image comprises a dark circle on a light background. This indicates that the original inputted image is permanent in character.

EXAMPLE XXXIX

The imaged member of Example XXXVIII is again subjected to a field of opposite polarity for about 1/10 second and simultaneously flooded with visible light and returned to its initial polarity to erase any temporary images.

The member is then exposed, with visible light, through the NESA electrode to an imagewise pattern of an opaque square on a transparent mask out of registry with the circle.

Again the images on the member are read out and observed to comprise a dark circle and a dark square on a light background.

EXAMPLE XL

The imaged member of Example XXXIX is subjected to the described erasure procedure and then exposed to an opaque image of a triangle on a transparent mask out of registry with the circle and square.

Upon reading the images out, it is observed that only the dark circle and triangle are visible. The square no longer exists as a viewable image and the circle is permanently impressed into the member.

EXAMPLES XLI — XLIII

Example XXXVII is followed except with that the UV exposure is for about the following time periods:

| |
|---|
| 11 hours |
| 6 hours |
| 1½ hours |

In each instance, the results are observed to be the same as set forth in Example XXXVII, i.e., an image is entered into the member.

EXAMPLES XLIV — LII

Each of the three imaged members of Examples XLI–XLIII are subjected to each of the steps set forth in Examples XXXVII–XXXIX.

In each instance, it is observed that the original image is permanent and the member may be sequentially updated with erasable image information.

EXAMPLE LIII

A piece of cardboard with a ½ inch diameter circle cut therethrough is placed on the conductive surface of a NESA glass electrode and subjected to a high pressure stream of silica particles to thereby remove a portion of the tin oxide corresponding to the circle. Then, as in Example I, the imaging member is fabricated by applying a screen, a photoconductive layer, an elastomer layer and a surface electrode layer.

The imaging member thus created is then uniformly exposed to visible light through the NESA electrode and read out with Schlieren optics. The image observed on the viewing screen comprises a black circle an a light background.

EXAMPLE LIV

The imaged member of Example LIII is erased as described in Example II and then exposed to visible light through transparent mask having thereon an imagewise opaque pattern of a square out of registry with the circle.

Again the imaged member is read out and observed to contain two images, displayed as a dark circle and a dark square on a light background.

EXAMPLE LV

The imaged member of Example LIV is subjected to the described erasure procedure and then exposed to an opaque image of a triangle on a transparent mask out of registry with the circle and square.

Upon reading the images out, it is observed that only the dark circle and triangle are visible. The square no longer exists as a viewable image and the circle is permanently impressed into the member.

EXAMPLE LVI

The first paragraph of Example I is followed to create a NESA substrate with an optical screen thereon.

A photoconductive solution is then prepared by slowly stirring about 78 grams of poly-n-vinyl carbazole (PVK) into about 1200 cc of tetrahydrofuran (THF) at room temperature. After the PVK is completely dissolved, about 52 grams of 2, 4, 7-trinitroflourenone (TNF) are added and the solution is stirred over night. The resulting solution viscosity is about 100 cPs. The solution is then filtered and dip coated onto the screen substrate to provide an about 5 micron layer thereon. Then, an about 6 micron layer of 50% by weight plasticized Dow Corning 182 elastomer is coated onto the photoconductor. Finally, an about 0.1 micron layer of gold-indium-chromium in vacuum deposited on the free surface of the elastomer.

The member thus created is then subjected to 16,300 cycles in the following sequence:

about 400 volts is applied between electrodes; about one second later an imagewise pattern of a ½ inch diameter transparent circle is exposed through the NESA electrode, illumination exposure equal to about 1,000 ergs/cm$^2$/sec. white light; about one second later the image is read out by conventional Schlieren optics; about 1 second later the voltage is turned off; about one second layer the cycle is repeated.

It is observed that the image recorder has an increase in diffraction efficiency (DE) of from about 51% to about 66% and a zero replication (ZR) increase of from about 3% to about 6.7%. Zero replication is the diffraction efficiency measured from the imaging member with no voltage applied to the system and is caused by imperfection within the system such as cold working, dust, etc.

After the final cycle, the member is exposed to uniform illumination of a wavelength less than 6800 angstroms and the image is read out by Schlieren optics and displayed on a projection screen. It is further observed that the member contains an image of a bright circle on a light background.

EXAMPLES LVII – LVIII

Example LXVI is followed except that the number of cycles, diffraction efficiencies and zero replication are as follows:

| NO. CYCLES | DE | ZR |
|---|---|---|
| 31,780 | 75% | 10% |
| 82,800 | 82% | 30% |

In each instance, it is observed that the results are similar to those of Example LXVI, i.e., an image has been impressed into the imaging member.

EXAMPLES LIX – LXII

Example LXVI is followed except that the applied voltage is about 500 volts, the initial DE is about 63% and the initial ZR is about 0.6%, and the cycles, diffraction efficiencies and zero replications are as follows:

| NO CYCLES | DE | ZR |
|---|---|---|
| 14,500 | 73% | 4.6% |
| 30,300 | 68% | 8.8% |
| 80,800 | 66% | 21% |
| 148,500 | 49% | 37% |

In each instance, it is observed that the results are similar to those of Example LXVI, i.e., an image has been impressed into the imaging member.

EXAMPLES LXIII – LXIX

Each of the imaged members of Examples LVI-LXII are subjected to a field of opposite polarity for about 1/10 seconds, simultaneously flooded with visible light and returned to its initial polarity, thereby erasing any temporary images.

The imaging member is then again uniformly exposed to visible light through the NESA electrode and read out with Schlieren optics. It is observed that the read out image comprises a bright circle on a light background. This indicates that the original inputted image is permanent in character.

EXAMPLE LXX

Example I is followed through paragraphs 1 and 2 except that the screen pattern is not applied, then, an approximately 5 mirron thick layer of elastomer comprising a dimethylpolysiloxane gel is applied over the photoconductive layer.

Then, an about 500 angstrom thick uniform flexible conductive gold-indium layer is applied to the free surface of the elastomer layer by vacuum evaporation. A mask comprised of about ½ mil diameter steel wires about 5 inches long supported within a square frame on about 25 micron centers to create an about 5 inch × 5 inch matrix is then placed in close proximity to the uniform metal layer. By vacuum evaporation, another 500 angstrom thick layer of gold-indium is applied to the member. The mask is then removed. It is observed that the surface electrode comprises a 40 cycle bar pattern.

An electrical field of about 350 volts is established across the imaging member by the well-known double-sided corona charging technique. From the NESA side, the member is exposed through a mask comprising an opaque square on a transparent background. The image is read out with conventional Schlieren optics and displayed on a projection screen.

It is observed that the projected image comprises a darker square on a light background. The solid area coverage is very good, indicating that the screen modulation pattern built into the surface electrode has modulated the image information as desired.

EXAMPLE LXXI

The imaged member of Example LXX is then discharged by grounding and simultaneously flooded with visible light, thereby erasing any temporary images.

The imaging member is again provided with an electric field of about 350 volts and exposed from the NESA side through a mask comprising an opaque circle on a transparent background. Upon, readout, it is observed that the image comprises a darker circle on a light background. Good solid are coverage is also observed. The permanence of the line pattern is confirmed by this cycling procedure.

EXAMPLE LXXII

Example I is followed through paragraphs 1 and 2, except that the screen pattern is not applied, then, an approximately 5 micron thick layer of elastomer comprising a dimethylpolysiloxane gel is applied over the photoconductive layer.

Then a wire mask, as described in Example LXX, is placed in close proximity to the free surface of the elastomer layer and an about 0.1 micron thick layer of flexible conductive gold-indium is applied to the member through the mask. The mask is removed and it is observed that a 40 cycle pattern has been created on the surface of the imaging member.

The member is then charged and imaged as described in paragraph 3, of Example LXX. Then, the image is read out by Schlieren optics and displayed on a projection screen.

It is observed that the projected image comprises a light square on a dark background. The solid area coverage is very good, again indicating that the screen modulation pattern built into the surface electrode has modulated the image information as desired.

EXAMPLE LXXIII

Example I is followed through paragraphs 1 and 2, then an approximately 5 micron thick layer of elastomer comprising a dimethylpolysiloxane gel is applied over the photoconductive layer.

Then, an about 800 angstrom thick uniform flexible conductive gold-indium layer is applied to the free surface of the elastomer layer by vacuum evaporation. A mask comprising a piece of ⅛ inch thick aluminum with a ½ inch diameter circle cut there through is then placed in contact with the metal layer and an additional 400 angstrom thick layer of gold-indium is vacuum evaporated onto the member through the opening. The mask is removed and it is observed that the metal electrode layer comprises a relatively uniform layer with a circular protrusion thereon.

Next, an electrical field of about 340 volts is established across the imaging member by applying a potential to the electrodes, and the member is then uniformly exposed through the NESA glass electrode to visible light having a wavelength below 6800 angstroms. The image is read out through conventional Schlieren optics and displayed on a projection screen. It is observed that the projected image is made up of a dark circle with a light background which indicates that the desired image has been entered into the member.

EXAMPLE LXXIV

The imaged member of the Example LXXIII is then subjected to a field of opposite polarity for about 1/10 second, simultaneously flooded with visible light and returned to its initial polarity, thereby erasing any temporary images.

The imaging member is then again uniformly exposed to visible light through the NESA electrode and read out with Schlieren optics. It is observed that the readout image comprises a dark circle and a light background. This indicates that the original inputted image is permanent in character.

EXAMPLE LXXV

The imaged member of Example LXXIV is again subjected to a field of opposite polarity for about 1/10 second and simultaneously flooded with visible light and returned to its initial polarity to erase any temporary images.

The member is then exposed, with visible light, through the NESA electrode to an imagewise pattern of an opaque square on a transparent mask, out of registry with circle.

Again the images on the member are read out and observed to comprise a dark circle and a dark square on a light background.

EXAMPLE LXXVI

The imaged member of Example LXXV is subjected to the described erasure procedure and then exposed through a transparent mask having an imagewise opaque pattern of a triangle thereon, out of registry with the circle and square.

Upon reading the images out, it is observed that only the dark circle and triangle are visible. The square no longer exists as a viewable image and the circle is permanently impressed into the member.

It will be understood that various changes in the details, materials, steps and arrangement of elements which have been described herein and illustrated in order to explain the nature of the invention will occur to and may be made by those skilled in the art upon reading of this disclosure and such modifications are intended to be included within the principle of the invention and the scope of the claims.

For instance, the examples and other portions of the specification refer to and illustrate positive-to-positive imaging which should not be taken as a limitation. As disclosed in the above-noted Sheridon patent, positive-to-negative imaging may easily be accomplished with a small change in the Schlieren read out optics.

Though not specifically delineated, it should also be realized that more than one permanent image may be impressed upon the imaging member and the different images may be associated with different layers of interfaces.

Although specific components proportions and process steps have been stated in the above description of the preferred embodiments of the invention, other suitable materials, proportions and process steps, as listed herein, may be used with satisfactory results and varying degrees of quality. In addition, other materials which exist presently or may be discovered may be added to materials used herein to synergize, enhance or otherwise modify their properties.

What is claimed is:

1. An imaging method comprising the steps of:

a. providing an imaging member comprising a voltage or current-sensitive light modulating layer overlying a layer of photoconductive material, said photoconductive layer being physically permanently modified by exposure to UV radiation in a first imagewise pattern;

b. applying an electrical field across said imaging member; and c. exposing said photoconductive material to a second imagewise pattern of activating radiation whereby images corresponding to said first and second imagewise patterns are formed in said imaging member.

2. The method of claim 1 wherein said voltage or current-sensitive light modulating layer comprises an elastomer material.

3. The method of claim 2 wherein said first imagewise pattern comprises a bar pattern which spatially modulates radiation propagated through the imaging member.

4. The method of claim 2 wherein said imaging member further includes a transparent conductive substrate adjacent said photoconductive layer and a flexible conductive metallic layer overlying said elastomer material layer.

5. The method of claim 3 wherein said imaging member further includes a transparent conductive substrate adjacent said photoconductive layer and a flexible conductive metallic layer overlying said elastomer material layer.

6. The method of claim 5 further including the step of optically reconstructing the images formed in the imaging member.

7. The method of claim 4 further including an insulating liquid layer adjacent the side of the conductive metal layer opposite from that to which the elastomer layer is adjacent.

* * * * *